US009440463B2

(12) United States Patent
Kudo

(10) Patent No.: US 9,440,463 B2
(45) Date of Patent: Sep. 13, 2016

(54) PRINT CONTROL APPARATUS, CONTROL METHOD THEREOF, AND STORAGE MEDIUM

(71) Applicant: CANON KABUSHIKI KAISHA, Tokyo (JP)

(72) Inventor: Naotoshi Kudo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/660,421

(22) Filed: Mar. 17, 2015

(65) Prior Publication Data

US 2015/0273893 A1 Oct. 1, 2015

(30) Foreign Application Priority Data

Apr. 1, 2014 (JP) ..... 2014-075719

(51) Int. Cl.

| | |
|---|---|
| ***B41J 29/38*** | (2006.01) |
| ***B41J 2/01*** | (2006.01) |
| ***B41J 11/66*** | (2006.01) |
| ***B41J 3/60*** | (2006.01) |
| ***B41J 15/04*** | (2006.01) |

(52) U.S. Cl.

CPC ..... *B41J 11/663* (2013.01); *B41J 3/60* (2013.01); *B41J 15/04* (2013.01)

(58) Field of Classification Search

CPC ..... B41J 3/60; B41J 15/04; B41J 15/042; B41J 11/70; B41J 29/393; B41J 15/02; B41J 11/68; B41J 29/38; B41J 11/663

USPC ..... 347/16, 19, 104

See application file for complete search history.

(56) References Cited

U.S. PATENT DOCUMENTS

2012/0056925 A1* 3/2012 Yamagishi ..... B41J 2/155 347/14
2012/0206550 A1* 8/2012 Takeuchi et al. ..... 347/104
2012/0299991 A1* 11/2012 Wakita ..... 347/16

FOREIGN PATENT DOCUMENTS

JP 2007-144960 A 6/2007

OTHER PUBLICATIONS

U.S. Appl. No. 14/553,072, filed Nov. 25, 2014; Inventors: Naotoshi Kudo.

* cited by examiner

*Primary Examiner* — Jannelle M Lebron
(74) *Attorney, Agent, or Firm* — Fitzpatrick, Cella, Harper & Scinto

(57) ABSTRACT

An embodiment of the present invention is directed to reducing problems in double-sided printing using roll paper. An apparatus in the embodiment includes a unit configured to cause a print unit to print on a roll-shaped print medium based on a received job for roll paper, a unit configured to control drive upon printing on the roll-shaped print medium, and a unit configured to cause a cutting unit to cut the roll-shaped print medium after printing the first surface of the roll-shaped print medium. The apparatus controls drive based on a first drive parameter for suppressing a first sheet-floating upon printing on the first surface of the roll-shaped print medium, and controls drive based on a second drive parameter for suppressing a second sheet-floating upon printing on the second surface of a cut print medium.

14 Claims, 6 Drawing Sheets

PRINT CONTROL APPARATUS, CONTROL METHOD THEREOF, AND STORAGE MEDIUM

BACKGROUND OF THE INVENTION

1. Field of the Invention

The present invention relates to a print control apparatus, a control method thereof, and a storage medium, and particularly to a print control apparatus capable of printing both surfaces of roll paper, a control method thereof, and a storage medium.

2. Description of the Related Art

Printing apparatuses have conventionally used various methods of double-sided printing on roll paper.

For example, there are a method of printing a front surface and a back surface without cutting roll paper into predetermined units and a method of printing a front surface and a back surface after cutting roll paper into predetermined units. When roll paper is cut into predetermined units before printing and handled like cut paper, printing can be done like printing on normal cut paper. On the other hand, when printing a small part of roll paper, for example, performing double-sided printing on roll paper corresponding to only one A4-size sheet, front surface printing is performed on the uncut roll paper. The roll paper is cut after the front surface printing, and the back surface of the roll paper (to be referred to as printed roll paper hereinafter) that has undergone the front surface printing is then printed. When performing front surface printing on roll paper, cutting the roll paper, and then performing back surface printing on the cut paper, as described above, the shape of the print medium changes between the front surface printing and the back surface printing.

Focusing on the difference in the state of the print medium between front surface printing and back surface printing, an extra margin is added to the rear end of the paper with the front surface image printed, and the roll paper is cut in this state. When inverting the cut print medium and refeeding the back surface, the print medium is conveyed such that the extra margin comes to the front end. There has been proposed such an inkjet printing apparatus (for example, Japanese Patent Laid-Open No. 2007-144960).

In Japanese Patent Laid-Open No. 2007-144960, however, the difference in the shape of the print medium when double-sided printing the printed roll paper is not taken into consideration.

When double-sided printing is executed for roll paper, which undergoes front surface printing as roll paper and undergoes back surface printing in a state close to cut paper, unevenness or a problem in printing may occur, as will be described later.

For example, when roll paper used in a large-scale printing apparatus is wide or long, the weight increases. When the roll paper is wound on a print medium paper tube, the weight of the paper tube is also included. For this reason, some printing apparatuses limit the maximum weight of roll paper to, for example, 40 kg. It is therefore necessary to increase the driving force to convey the roll paper.

Since even relatively light-weight roll paper that is narrow and short is conveyed by the same driving force, a back tension is added to the roll paper to apply a torque in a direction opposite to the conveyance direction. Hence, a force larger than the back tension by its own weight is applied.

On the other hand, in cut paper printing, a print medium is cut into a standard size or the like in advance. Some printing apparatuses limit the maximum length to, for example, 1.6 m. Hence, the cut paper weighs only several hundred grams and is much lighter than roll paper. For this reason, the back tension applied to a print medium at the time of conveyance largely changes between roll paper and cut paper even if the surface quality of the print medium is the same.

Since the roll paper receives a larger force of its own weight and the above-described back tension with respect to the same rotation amount of the conveyance rollers, a large amount of paper slip occurs, and the actual print medium conveyance amount decreases.

When printing cut printed roll paper as roll paper, the back tension applied to the print medium at the time of driving is smaller than that for roll paper. For this reason, when a normal conveyance amount is used, the print medium is conveyed too much, resulting in, for example, stripes in the printed image.

In addition, the paper floating amount also changes between roll paper wound into a roll and flat cut paper. When double-sided printing cut printed roll paper as roll paper, sucking may be too much, the print medium may stick to the platen, and conveyance may become impossible. Conversely, sucking may be too weak, resulting in paper floating.

In an inkjet printing apparatus, the head height changes not to make the ink discharge surface of the printhead contact the print medium at the time of paper floating. However, if cut printed roll paper is printed in the setting of roll paper, an appropriate height cannot be obtained.

SUMMARY OF THE INVENTION

Accordingly, the present invention is conceived as a response to the above-described disadvantages of the conventional art.

For example, a print control apparatus, a control method thereof, and a storage medium according to this invention are capable of obtaining a satisfactory printing result even by printing the front surface of roll paper, cutting the roll paper, and printing the back surface when double-sided printing roll paper.

According to one aspect of the present invention, there is provided a print control apparatus comprises: a reception unit configured to receive a job of double-sided printing of roll paper; a print control unit configured to cause a print unit to execute printing on a roll-shaped print medium based on the job received by the reception unit; a drive control unit configured to control drive upon executing printing on the roll-shaped print medium; and a cutting control unit configured to cause a cutting unit to cut the roll-shaped print medium after printing a first surface of the roll-shaped print medium, wherein after the print unit is caused to print an image on the first surface of the roll-shaped print medium, the print control unit causes the print unit to print the image on a second surface of a cut print medium obtained by cutting the roll-shaped print medium by the cutting unit, and the drive control unit controls drive based on a first drive parameter used to cope with a first sheet-floating upon executing printing on the first surface of the roll-shaped print medium, and controls drive based on a second drive parameter used to cope with a second sheet-floating upon executing printing on the second surface of the cut print medium.

The invention is particularly advantageous since it is possible to obtain a satisfactory printing result even when feeding or printing a corresponding back surface after printing the front surface of roll paper.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

In addition, "a printing element" is a general term for a nozzle (or orifice), a channel communicating with the nozzle, and a device for generating energy to be used to discharge ink, unless otherwise specified.

<Overall Outline of Printing Apparatus (FIGS. 1 to 2B)>

Figure 1:
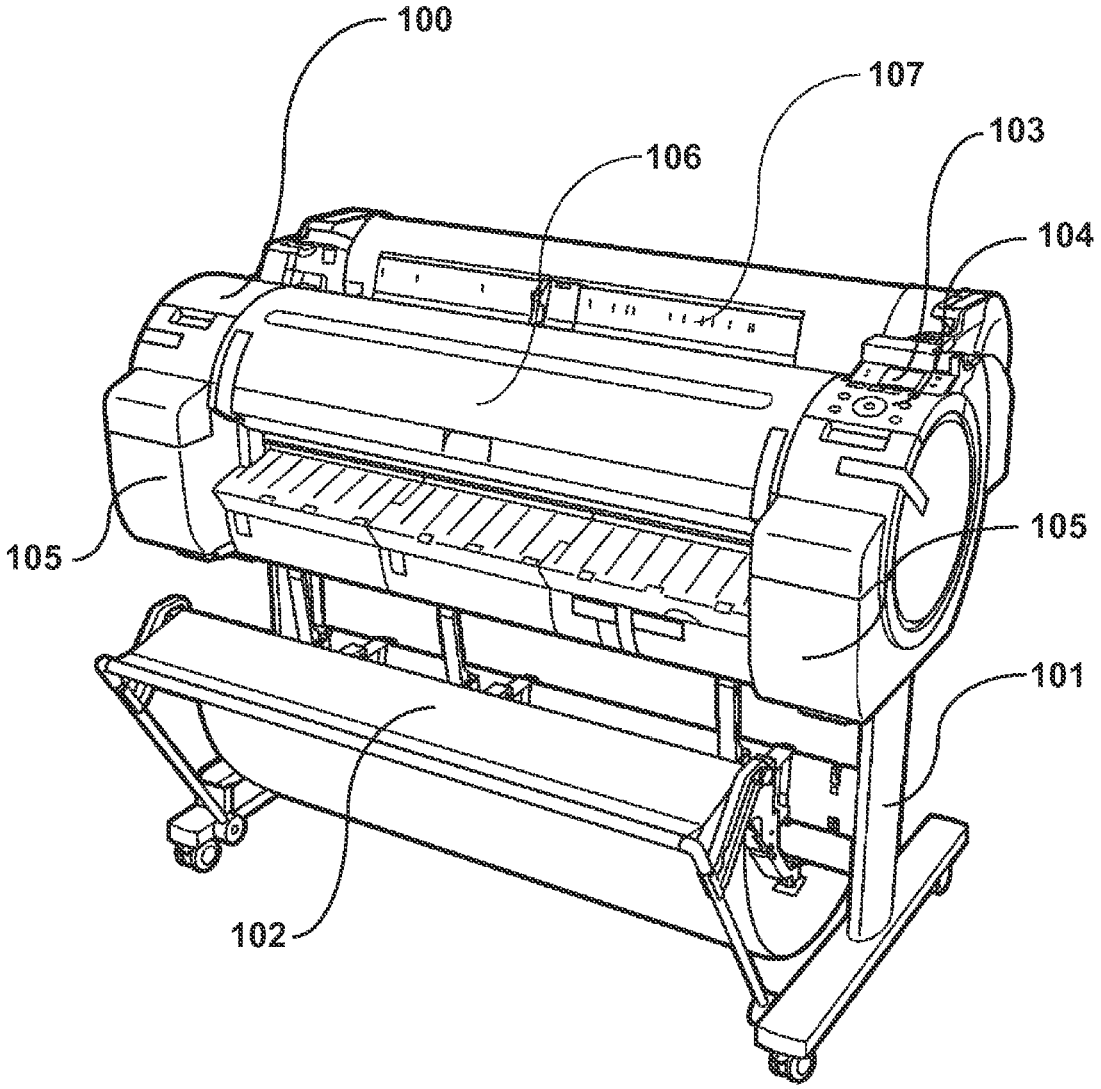
FIG. 1 is a perspective view showing the schematic outer appearance of an inkjet printing apparatus according to an exemplary embodiment of the present invention.

FIG. 1 is a perspective view showing the outer appearance of an inkjet printing apparatus according to an exemplary embodiment of the present invention, which uses a print medium of a large size such as AO or BO.

An inkjet printing apparatus (to be referred to as a printing apparatus hereinafter) 100 shown in FIG. 1 can print a 10- to 44-inch roll-shaped print medium (for example, roll paper). The printing apparatus 100 includes a stand 101 on which the main body is placed, and a stacker 102 on which discharged print paper is stacked. The printing apparatus 100 also includes a display panel 103 configured to display various kind of print information and setting results. An operation panel 104 used to set a print mode, print paper, and the like is disposed on the upper surface. An upper cover 106 capable of opening/closing is also provided.

Ink tank accommodation units 105 configured to accommodate ink tanks of black, cyan, magenta, yellow, and the like and supply inks to the printhead are arranged on both sides of the printing apparatus 100.

The printing apparatus 100 can use not only roll paper but also cut paper. Cut paper sheets are stacked on a feeding unit 107 and supplied into the printing apparatus 100 one by one along with the progress of print operation.

Figure 2A:
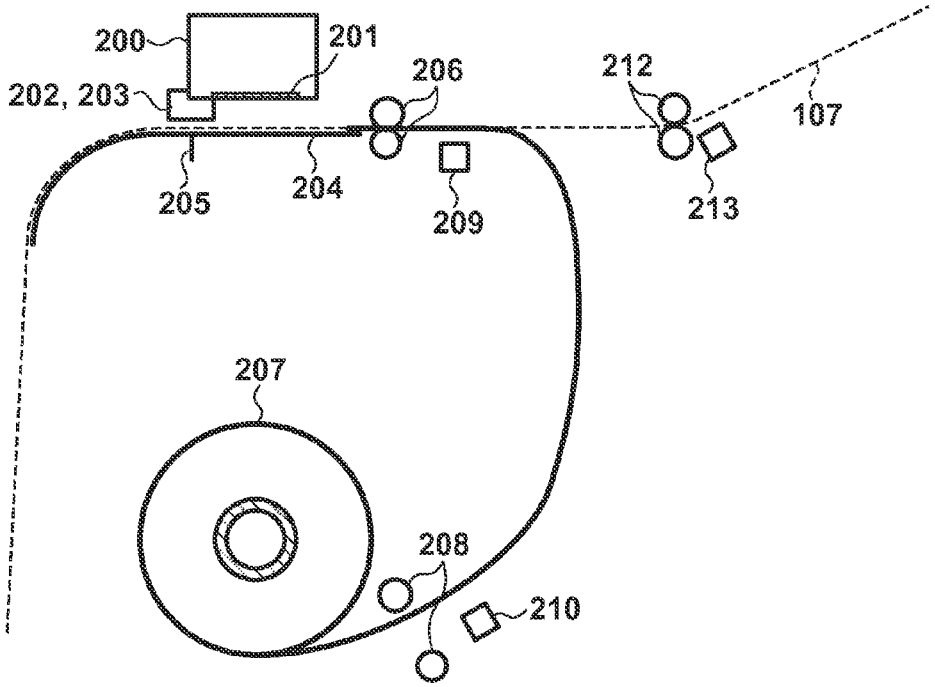
FIGS. 2A and 2B are side sectional views mainly showing the feeding mechanism of roll paper and cut paper in a printing apparatus 100 shown in FIG. 1.
Figure 2B:
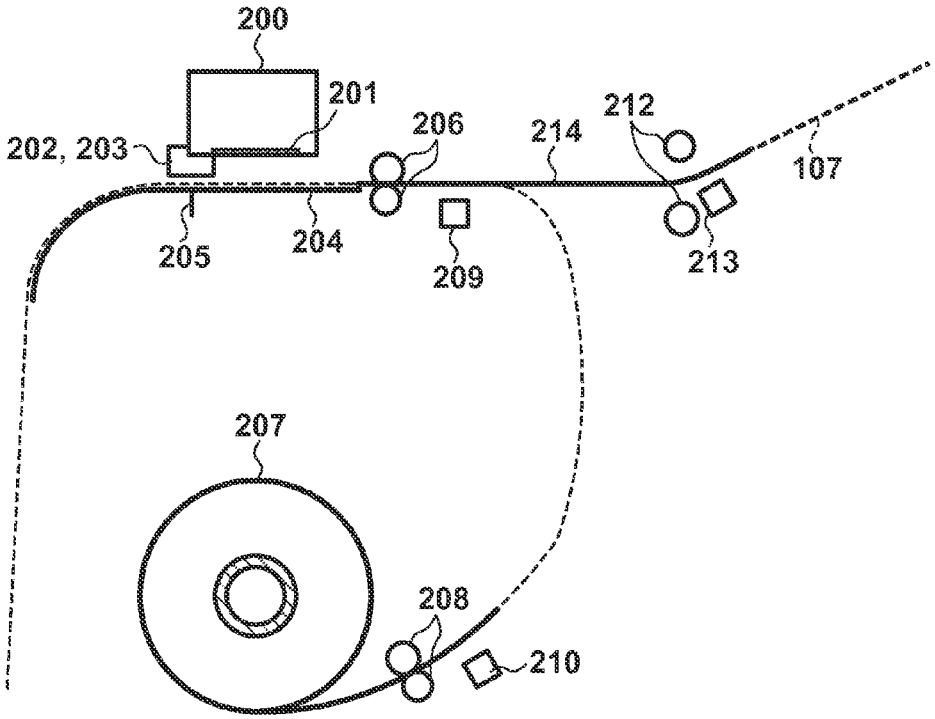

FIGS. 2A and 2B are side sectional views mainly showing the feeding mechanism of roll paper and cut paper in the printing apparatus 100 shown in FIG. 1. FIG. 2A shows the print standby state of roll paper, and FIG. 2B shows the print standby state of cut paper.

A carriage 200 shown in FIGS. 2A and 2B, on which an inkjet printhead (to be referred to as a printhead hereinafter) including a nozzle array 201 formed from a plurality of nozzles for discharging ink droplets is mounted, reciprocally moves in a direction perpendicular to the drawing surface. The nozzle array 201 discharges inks onto a print medium during reciprocal movement of the carriage 200, thereby performing printing. Since a linear encoder is attached to the carriage 200, the position in the carriage moving direction (main scanning direction) can be detected. Note that an example in which the carriage with the printhead mounted thereon reciprocally moves will be described here. However, the printhead may be provided linearly.

The carriage 200 incorporates a motor. When the motor is driven, the printhead mounted on the carriage 200 can move up and down. This makes it possible to automatically change the head height. The head height can be changed to five levels, that is, high, somewhat high, standard, somewhat low, and low.

Conveyance rollers 206 that connect a conveyance motor (not shown) and a rotary encoder (not shown) rotate by driving the conveyance motor while detecting the position by the rotary encoder, thereby conveying the print medium to left or right in the drawing. The conveyance rollers 206 are commonly used to convey roll paper and cut paper.

As shown in FIGS. 2A and 2B, a sensor unit 202 and a cutter unit 203 are arranged for the carriage 200 on the near and far sides, respectively, of the drawing surface. Hence, when the carriage 200 moves from the far side to the near side in the direction perpendicular to the drawing surface, the sensor unit 202 and the cutter unit 203 also move in the direction. Various LEDs are mounted on the sensor unit 202 whereby the end, thickness, and the like of many types of print media including non-paper type media such as a transparent film can be measured. As the carriage 200 moves, and the conveyance rollers 206 convey the print medium, the sensor unit 202 irradiates the print medium from above with light from a light-emitting element and receives the reflected light by a light-receiving element. The sensor unit 202 then detects the end position, thickness, and the like of the print medium based on the received light, the position of the carriage 200, and the position of the conveyance rollers 206.

When the sensor unit 202 detects the front end position of the print medium, the print medium is conveyed downstream in the conveyance direction and irradiated with light. In this state, the conveyance rollers 206 are driven to rewind the print medium to the upstream side. An encoder value when the edges of a platen and the print medium are found, that is, when the light reception intensity by the light-receiving element varies is obtained, the position of the front end can be detected. When the print medium is moved to the position of the encoder, the front end of the print medium is located immediately under the sensor position.

The cutter unit 203 mounted on the carriage 200 is a cutting unit. A round blade is mounted on the cutter unit 203. When the carriage 200 is moved to the far side in the direction perpendicular to the drawing surface and abutted against the cutter projecting member (not shown), the round blade as the blade in the cutter unit comes out. The carriage 200 is moved to the near side, thereby cutting the roll paper. The round blade that has come out of the cutter unit 203 has a projection toward the near side of the drawing surface, like the cutter projecting member on the far side. When the carriage 200 is moved to the near side so as to be abutted against the projection, the round blade is accommodated in the cutter unit 203. A flat blade 205 is mounted on a platen to be described later. The flat blade 205 and the round blade sandwich the print medium, thereby cutting the print medium.

A platen 204 supports the print medium from the lower side. The platen 204 has a plurality of holes and is configured to suck air by a suction fan (not shown). When the print medium is conveyed onto the platen 204, the print medium is sucked to the plurality of holes, and paper floating is prevented. Note that the suction fan can set the sucking to five levels, that is, strong, somewhat strong, standard, somewhat weak, and weak. These levels are called suction amounts.

The printing apparatus holds the suction amounts in tables separately for roll paper and cut paper in accordance with operations such as feeding and printing. The suction fan starts driving before an operation for the print medium, for example, before feeding or before printing and stops after the end of a series of operations. In this embodiment, roll paper and cut paper use the same value as the suction amount during conveyance at the time of image printing but use different values in feeding, cutting, and discharging operations at the time of printing.

FIG. 2A shows a state in which roll paper 207 is at the position of a print standby state. The roll paper 207 stands by at a position where the front end is conveyed by 5 mm in the conveyance direction from the holding position of the conveyance rollers 206. The shape of the set roll paper 207 is called a first shape. To feed the roll paper 207, the printing apparatus 100 includes one motor for rotating the roll paper and performs the feeding operation using a plurality of clutches (not shown), an encoder (not shown), a sensor (not shown), and the like. A paper tube indicated by hatching exists at the center of the roll paper. A shaft is extended through and fixed to the paper tube. The motor is connected to the shaft. A roll paper rotation clutch is connected between the shaft and the motor. When rewinding, the clutch is driven to rotate the roll paper and remove the slack of the print medium. A roll paper rotation detection encoder is connected between the shaft and the motor. This makes it possible to determine whether the roll paper has rotated. In addition, a torque limiter is connected between the shaft and the motor. When the roll paper is conveyed to the downstream side at the time of printing or the like, the torque limiter applies a predetermined torque in an opposite direction. That is, when driving the roll paper downstream in the conveyance direction, a predetermined back tension is applied. Reversely, when rewinding the roll paper upstream in the conveyance direction, no torque is applied.

The set roll paper 207 is fed toward the conveyance rollers 206 using feed rollers 208. The above-described motor is connected to the feed rollers 208. A pressure release clutch (not shown), a feeding clutch (not shown), and an encoder (not shown) are connected between the feed rollers 208 and the motor. When the pressure release clutch is driven to drive the motor, the feed rollers 208 can be set to an open position, as shown in FIG. 2A, or closed to move the roll paper to the retracted position to retract, as shown in FIG. 2B.

When the feeding clutch is driven to drive the motor in the closed state of the feed rollers 208, the feed rollers 208 can rotate to feed the set roll paper to the left or right in FIGS. 2A and 2B. In addition, the feeding encoder (not shown) between the motor and the feed rollers 208 can measure the rotation amount of the feed rollers 208 and control the conveyance amount.

Sensors 209, 210, and 213 are reflection sensors capable of determining the presence/absence of the print medium in the conveyance paths. Each sensor is provided with a light-emitting element and a light-receiving element. The light-emitting element emits light, and the light-receiving element receives the reflected light, thereby determining the presence/absence of the print medium.

In this embodiment, to change the roll paper use state as shown in FIG. 2A to the cut paper use state as shown in FIG. 2B, the roll paper needs to be retracted. To do this, first, the feed rollers 208 are closed as shown in FIG. 2B. After that, the conveyance rollers 206 and the feed rollers 208 are driven in the direction to rewind the roll paper until the sensors 209 and 210 determine the absence of the print medium. When the absence of the print medium is determined, the feed rollers 208 are driven in the feeding direction reverse to the above-described direction. The feeding encoder calculates the conveyance amount. The roll paper is fed by 5 mm from the point of time when the sensor 210 has determined the presence of the print medium and stopped. This position is the retracted position shown in FIG. 2B.

Reversely, to change the roll paper from, for example, the new feed state shown in FIG. 2B to the print standby state shown in FIG. 2A, first, the feed rollers 208 and the conveyance rollers 206 are rotated to convey the roll paper 207 until its front end moves onto the platen 204. That is, when conveying the print medium until the roll paper is held by the conveyance rollers 206, the feed rollers 208 are opened as shown in FIG. 2A. After that, the conveyance rollers 206 and the carriage 200 are operated, and the sensor unit 202 detects end positions such as the front end and the paper width of the roll paper. After the positions are detected, the conveyance of the roll paper is stopped at a position where the print medium is fed by 5 mm from the holding position of the conveyance rollers 206, and the feeding operation is ended. This position is the print standby position.

Cut paper 214 is mounted on the feeding unit 107 and fed by feed rollers 212. The presence/absence of the cut paper stacked on the feeding unit 107 can be determined by the reflection sensor 213. FIG. 2A shows the unfed (absence) state of the cut paper mounted on the feeding unit 107 because the roll paper is fed up to the conveyance rollers 206. Note that the shape of the cut paper when placed is called a second shape.

When the cut paper is placed on the feeding unit 107, the roll paper is retracted, as shown in FIG. 2B, and the cut paper is conveyed to the conveyance rollers 206 by the feed rollers 212. When the print medium is conveyed up to the conveyance rollers 206, the feed rollers 212 are released, as shown in FIG. 2B. After that, the print medium is conveyed only by the conveyance rollers 206, like the roll paper. Like the roll paper, the print medium is pulled onto the platen 204, and a feeding operation such as end detection is performed. The front end of the print medium is conveyed to the position 5 mm apart from the conveyance rollers 206, as shown in FIG. 2B, and the feeding operation is ended. The position shown in FIG. 2B is the print standby state of the cut paper.

In this embodiment, after the first surface (to be referred to as a front surface hereinafter) of roll paper is printed, the roll paper is cut, and the second surface (to be referred to as a back surface hereinafter) is printed. The roll paper cut after printing the front surface is defined as printed roll paper having a third shape. In this embodiment, when the size of the cut printed roll paper is close to the size of cut paper cut into a standard size in advance, for example, when the length in the sheet conveyance direction is relatively short, the printed roll paper is fed to the feeding unit 107 and printed like cut paper having the second shape. More specifically, when executing printing on the second surface (to be referred to as a back surface hereinafter), not the driving parameters for roll paper but the driving parameters for cut paper are used to do printing. This can reduce the problems at the time of execution of back surface printing caused by the difference in the shape. That is, it is possible to suppress unevenness or a problem in printing execution. Although details will be described later, when executing printing on the back surface, not the driving parameters for cut paper but the driving parameters for printed roll paper including the printed density may be used as the parameters for printed roll paper having the third shape. This makes it possible to do an operation using more appropriate driving parameters and further reduce the problems at the time of execution of back surface printing. In this embodiment, as a driving parameter, a parameter to cope with floating of a sheet is changed between the front surface and the back surface. Examples of parameters to cope with sheet floating are a parameter concerning the suction amount of the print medium and a parameter concerning the height of the printhead of the print unit.

The conveyance amount by the conveyance rollers 206 needs to be changed between roll paper and cut paper. When the roll paper 207 that weights 40 kg at maximum is fed by the feed rollers 208, as shown in FIG. 2A, a force to rotate the set roll paper connected to the roll paper 207 is also necessary. In this embodiment, a predetermined load is obtained by applying a back tension. For this reason, at the time of conveyance by the conveyance rollers 206, the load is heavier than that of cut paper, and paper slip occurs.

For example, when 100 driving pulses are input to the conveyance motor, and the roll paper is conveyed by the conveyance rollers 206, the roll paper is assumed to move forward by 50 mm. On the other hand, for the cut paper 214 as shown in FIG. 2B, the load on the upstream side, that is, on the right side of FIG. 2B is almost zero as compared to the roll paper, and paper slip rarely occurs. For example, in this case, when 100 driving pulses are input to the conveyance motor, the cut paper is assumed to move forward by 100 mm. As described above, to convey the same distance of 100 mm, 100 pulses are needed for the cut paper, and 200 pulses are needed for the roll paper. In this example, the conveyance correction value of the cut paper is set to 1, and the conveyance correction value of the roll paper is set to 2. When the conveyance amount of the conveyance rollers 206 is multiplied by the correction value, the conveyance pulses to drive the motor when conveying the print medium by 100 mm can be calculated.

The actual conveyance amount when driving pulses corresponding to 100 pulses in the conveyance amount are input to the conveyance motor can be obtained by, for example, conveying the print medium that has undergone printing and detecting the end by the sensor unit 202 as in end detection. This can obtain the correction value from the actual conveyance amount of the currently set print medium. In this embodiment, correction value data obtained in advance is held in the internal memory of the main body of the printing apparatus. In fact, different numerical values are held separately for roll paper and cut paper depending on conditions such as the paper type, paper width, and number of print passes. In this embodiment, same numerical values are used for cut paper and cut printed roll paper.

Note that the user himself/herself may execute adjusted printing to obtain the correction value. When, for example, the back tension is not constant, the conveyance amount changes depending on the weight of roll paper. Hence, a correction value according to the weight, remaining amount, print mode, environmental conditions such as temperature/humidity, and the like may be held. As described above, the conveyance correction value of cut paper is used when refeeding or printing the back surface of printed roll paper. It is therefore possible to reduce conveyance errors as compared to conveyance for refeed or printing of roll paper.

The paper slip amount changes between a white paper state and a printed state with an ink on the sheet surface. The density of a print area that should come to the position of the conveyance rollers 206 is calculated from the driving amount of next printing. When an operation is performed after adding the density to the parameters for cut paper, the conveyance errors of the cut printed roll paper are further be reduced. That is, the back surface printing parameters for printed roll paper are considered.

For example, like the above-described difference between roll paper and cut paper, assume that 100 driving pulses are needed to convey cut paper of a certain paper type by 100 mm when the density on the sheet surface in a white paper state is 0%. On the other hand, 80 pulses may be needed when the area density of a sheet surface wholly covered with an ink is 100%, and 90 pulses may be needed when the area density is ½, that is, 50%. In this case, the correction value (correction amount) can be calculated by linear interpolation. The conveyance amount of cut paper is multiplied by the calculated correction value. For example, to convey 100 mm, number of pulses to convey 100 mm=number of pulses (100) of cut paper×$(1-0.2\times D/100)$ is obtained, where $D$ is the density (%).

Described above is merely an example, which is simple for the descriptive convenience. The calculation formula may be changed depending on the paper type, and the correction values may be held in a table.

That is, in the paper type of the above-described example, the slip amount is larger at the time of conveyance of the print medium where no ink is discharged than that where ink is discharged. For a paper type in which the slip amount is larger at the time of conveyance of the print medium where ink is discharged than that where no is discharged, the relationship reverses, and the calculation formula changes, as a matter of course.

As for the suction amount of the platen 204, a sequence of sucking the print medium to the platen is performed by a load operation in normal printing. When the print medium is sucked, the operation of conveying it during image forming of printing is performed using the same suction amount for both roll paper and cut paper. In the sucking sequence, the front end of the print medium is conveyed downstream up to a position where the print medium lowers by its own weight, and the print medium is brought into tight contact with the platen using the lowering of the print medium by its own weight. In the state in which the print medium is in tight contact with the platen, suction is continued to rewind the print medium up to a necessary position, thereby preventing paper floating. This operation is called a sucking operation.

When using roll paper, the roll paper is pulled out from the wound state and used. Hence, the roll paper curls. On the other hand, cut paper is not wound. Although depends on the paper type or environment, since roll paper is pulled out from the wound state, roll paper made of thick paper or the like lowers at its front end and rises slightly inward from the front end. Reversely, cut paper is straight, but the front end slightly floats. Cut printed roll paper is turned over, and the front end floats, like the cut paper. For this reason, as the suction amount of the platen 204, different values are used for cut paper and roll paper until the sucking operation of the print medium ends.

In the sucking operation when the front end of cut paper floats, as described above, the cut paper needs a larger suction amount than the roll paper to prevent paper floating at the time of rewind. The magnitude relationship of suction amounts may reverse depending on the paper type, for example, when the print medium is made of not thick paper but thin paper. The sucking operation is not performed for sequences other than conveyance in image printing. For this reason, the printing apparatus 100 holds suction amounts in tables separately for roll paper and cut paper in correspondence with the feeding operation, and the load operation, cutting operation and discharge operation in printing. Conveyance in printing is performed after the sucking operation during the load operation in printing. Hence, the same suction amount is used for roll paper and cut paper. As for the height of the printhead, numerical values are held in a table for each paper type in accordance with a print mode such as photo or line drawing and environmental conditions such as temperature/humidity, and a position so low as not to bring the ink discharge surface of the printhead into contact with the print medium is set.

For this reason, cut printed roll paper uses the value of cut paper whose manner the print medium floats is closer than roll paper, like the above-described suction amount. That is, the value of cut printed roll paper is the same as the value of cut paper. This can reduce paper floating and prevent the print medium from contacting the ink discharge surface of the printhead.

However, since turned over in refeed, the printed roll paper may have strong curl reverse to that of normal roll paper. For this reason, the above-described thick paper or the like may have a larger curl amount than in the state of cut paper. That is, a larger suction amount is necessary. In such a case, instead of directly using the value of cut paper, the value of cut printed roll paper may be changed by, for example, raising the level of suction amount by one step as compared to that of cut paper.

For a print medium such as thin paper that sticks and cannot be operated, the level of suction amount may be lowered by one step as compared to the value of a standard paper type. For a thin paper type whose paper floating state changes depending on the layer of an ink discharged onto the sheet surface, the suction amount may be changed in accordance with the printed density, like the conveyance correction value. For example, when the printed density in 100 mm at the front end is 30% or more in back surface printing, adjustment is done by, for example, increasing the suction amount by one step (or decreasing the suction amount by one step) as compared to the value of a standard paper type. This adjustment is performed not only to use the parameters for cut paper but also to consider the parameters for cut printed roll paper, that is, parameters for back surface printing.

The curl amount varies depending on the type of the print medium and also changes in accordance with other conditions such as the environment. Hence, depending on the type of the print medium or other conditions, not the same values as those of cut paper but the same values as those of roll paper may be set to the parameters for cut printed roll paper.

Figure 3:
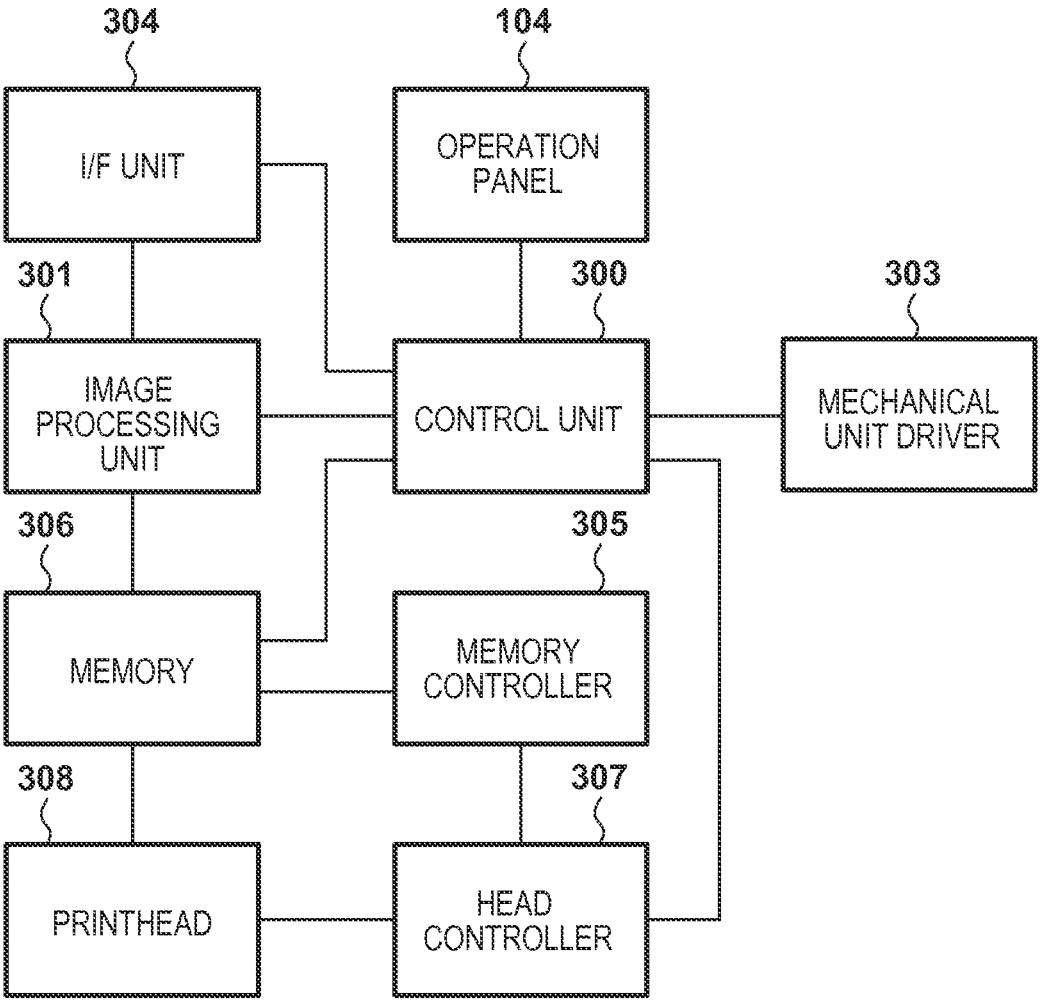
FIG. 3 is a block diagram showing the control arrangement of the printing apparatus shown in FIG. 1.

FIG. 3 is a block diagram showing the control arrangement of the printing apparatus shown in FIG. 1.

A control unit 300 controls the entire printing apparatus 100. The printing apparatus 100 is connected to a host computer (not shown: to be referred to as a host hereinafter) by an interface (I/F) unit 304. A command and print data to be printed are transferred from the host, and the printing apparatus 100 operates in accordance with the command, thereby printing an image based on the print data on a print medium. When information of the printing apparatus 100 is transferred to the host, the host can be notified of the state of the printing apparatus, and the user can thus be notified of information of the print medium. As the I/F unit 304, a centronics or USB interface is often used.

An image processing unit 301 formed from a memory, ASIC, DSP, RISC chip, and the like performs y-correction, color processing, resizing processing, binarization, and the like for print data (multivalued image data) transferred from the host via the I/F unit 304. As for the arrangement and function of the image processing unit 301, the processing may be performed by a driver or a RIP (Raster Image Processor) on the host side to reduce the cost of the main body. Image data bitmapped into a dot pattern at the final stage of processing by the image processing unit 301 is temporarily stored in a memory 306.

The printed density on a sheet surface can be calculated from the image data. The density information is also stored in the memory 306. The memory 306 is configured to store image data corresponding to one band or more necessary for a printhead 308 to move once in the main scanning direction and print. The memory 306 is also used to store information of the end position and width of the print medium and main body information such as the conveyance correction value of the print medium. Image data write/read to/from the memory 306 is done by a memory controller 305 under the control of the DSP or RISC chip of the image processing unit 301. The memory controller 305 also generates an address signal and a write/read timing signal to the memory 306.

Image data read out from the memory 306 is output to a head controller 307 in synchronism with a read signal from the head controller 307. Based on an encoder signal from a linear scale (not shown), the head controller 307 generates an ink discharge timing signal or heat pulse to the printhead 308 under the control of the control unit 300.

The printhead 308 is part of the print unit and includes a nozzle array corresponding to black, cyan, magenta, and yellow inks, as described above. The printhead 308 heats the heaters provided in the nozzles under the control of the control unit 300 and the head controller 307 and prints an image on a print medium. The printhead 308 is actually attached to the carriage 200 driven by a mechanical unit driver 303. The mechanical unit driver 303 is formed from a carriage driving unit configured to move the printhead 308 in the main scanning direction and the vertical direction, a conveyance control unit configured to convey the print medium, a recovery unit of the printhead, a suction fan control unit configured to suck the print medium, a motor, an encoder, a sensor, and the like.

The sensor unit 202 is attached to the carriage 200. When the carriage 200 is moved, the sensor mounted on the carriage 200 calculates the changed position based on an encoder signal from a linear scale (not shown), thereby obtaining widthwise end information of the print medium. The width of roll paper is calculated from the end position information.

As the conveyance correction values of a print medium, the memory 306 stores three levels of correction values for each paper type in accordance with the width of the print medium. When conveying the print medium, the control unit 300 obtains the conveyance correction value from the memory 306. In addition, the carriage 200 is fixed to a predetermined position, and the conveyance rollers 206 are operated to convey the print medium. The sensor mounted on the carriage 200 calculates the changed position of the conveyance rollers 206 based on an encoder signal from a rotary encoder attached to the conveyance rollers, thereby obtaining front end position information. Calculated information of the print medium such as the position or paper width is saved in the memory 306. The head height or platen suction amount at the time of feeding or printing is also saved in the memory 306 in advance.

The operation panel 104 includes various switches and keys, and the state of the printing apparatus 100 or a menu for an operation is displayed on the display panel 103. The control unit 300 displays a picture, character, or the like on the screen of the display panel 103, and the user can monitor it. When the user operates the keys while viewing the screen, the printing apparatus 100 can know, for example, completion of setting of printed roll paper in the feeding unit 107.

Embodiments of conveyance control of double-sided printing on roll paper using a printing apparatus having the above-described arrangement will be described next.

First Embodiment

Figure 4A:
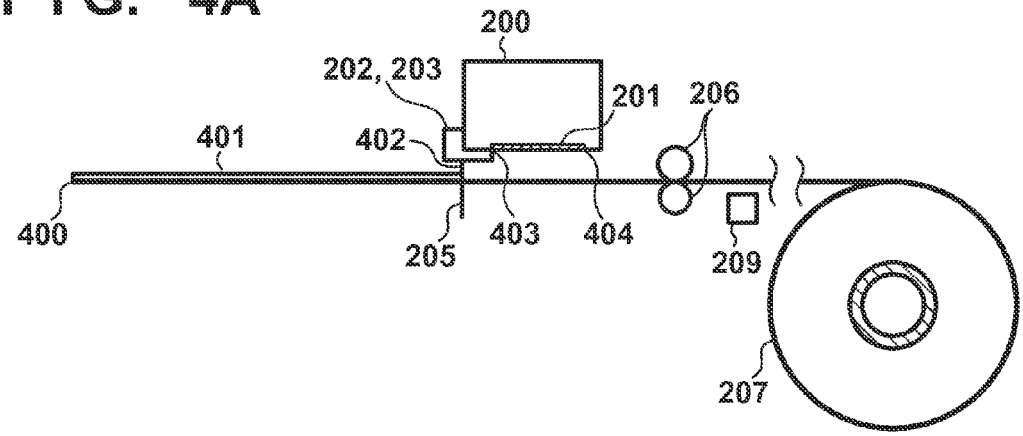
FIGS. 4A, 4B, 4C, and 4D are side sectional views showing part of a printing apparatus so as to illustrate an example of states at the time of printing according to the first embodiment.

FIGS. 4A to 4D are side views showing an example of states at the time of printing. In FIGS. 4A to 4D, the side sectional views of FIGS. 2A and 2B are partially omitted or simplified, and the states at the time of printing are illustrated. FIG. 4A shows a state immediately after the end of cutting of roll paper that has undergone front surface printing. Referring to FIG. 4A, the upstream side of a sensor 209 on the right side is not illustrated. In fact, the print medium on the downstream side, that is, on the left side of FIG. 4A moves downward by its own weight, as indicated by the broken line in FIGS. 2A and 2B. However, the print medium is illustrated as if it were conveyed on a straight line for the descriptive convenience. Here, the front surface printing of the roll paper may end in a predetermined print unit (for example, one page). Alternatively, images may continuously be printed not for a predetermined print unit but for a predetermined length (for example, plural pages), and then the printing may end. In this embodiment, a case will be described where printed roll paper cut after the end of front surface printing has a length that allows the paper to be handled as cut paper. Note that if images are continuously printed for a predetermined length to form printed roll paper having the third shape, the roll paper is cut into predetermined print units after the back surface has been printed.

As shown in FIG. 4A, printed roll paper 400 having the third shape includes a portion (front surface print area) 401 where inks have been discharged to print an image by front surface printing. Unlike cut paper or cut printed roll paper, inks can be discharged anywhere on the print medium as long as the print medium is connected to roll paper 207. When a round blade 402 that has come out of a cutter unit 203 combines with a flat blade 205, and a carriage 200 moves from the far side to the near side of the drawing surface, the roll paper 207 is cut. FIG. 4A shows the state after the end of cutting. The printed roll paper 400 is cut off from the roll paper 207. In not double-sided printing but single-sided printing, the print operation is completed here.

Figure 4B:
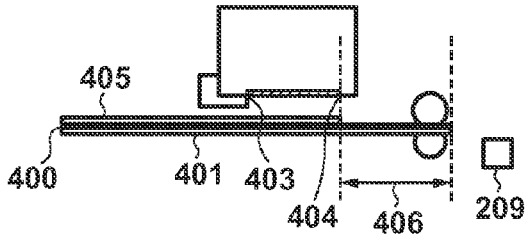

FIG. 4B is a view showing a state in which the printed roll paper 400 shown in FIG. 4A is turned over and fed to a feeding unit 107, and back surface printing is performed, like cut paper. Note that FIG. 4B shows only the portion on the downstream side of the sensor 209 shown in FIG. 4A in the conveyance direction. In case of cut paper, when the print medium is conveyed to the downstream side from the position shown in FIG. 4B, the print medium passes through conveyance rollers 206, and conveyance of the print medium is no longer possible. In fact, the front end of the print medium hangs by its own weight on the downstream side, that is, the left side in the conveyance direction, as shown in FIGS. 2A and 2B. Hence, after passing through the conveyance rollers 206, the print medium falls by its own weight. Since the print medium is not located under a printhead 201, printing is impossible.

For this reason, the position shown in FIG. 4B is the position where the print medium has been conveyed to the most downstream side. That is, in FIG. 4B, since no inks can be discharged from the nozzles to the upstream side of a most upstream nozzle 404, the portion of the print medium from the most upstream nozzle 404 to the downstream side is a printable area. That is, a back surface printable area 405 and an unprintable area 406 are formed on the back surface. Additionally, in back surface printing on cut paper, printing can be performed only in the same area as the back surface printable area 405. On the other hand, when printing roll paper as shown in FIG. 4A, printing can be performed at any position. When the sensor 209 has determined the absence of the print medium, there is no print medium having a sufficient length to complete printing of remaining images, and therefore, printing is normally stopped. Note that a numeral 403 indicates a most downstream nozzle of the printhead.

In the case shown in FIG. 4B, to make the unprintable area 406 as small as possible, the rear end of the image shown in the back surface printable area 405 is printed by the most upstream nozzle 404, and the print medium is conveyed up to a position where a state in which the sensor 209 determines the absence of the print medium is obtained.

For this reason, since printing using cut paper is performed in the state as shown in FIG. 4B, image rear end printing processing for cut paper considering usable nozzles is performed, unlike roll paper. Hence, the same rear end printing processing as that for cut paper is performed when back surface printing of printed roll paper is performed in double-sided printing. In double-sided printing of roll paper, when cut printed roll paper is simply fed to the feeding unit 107, and back surface printing is performed like cut paper, the printable area changes between the front surface and the back surface, as shown in FIGS. 4A and 4B. As described above, the front surface print area 401 is not limited unless roll paper is cut or paper out occurs. On the other hand, a margin corresponding to the unprintable area 406 is formed on the back surface.

In this embodiment, at the time of front surface printing, the margin corresponding to the back surface unprintable area 406 is set in advance, and the print medium is cut. The print medium is fed to the feeding unit 107 and printed again like cut paper. This solves the problem that the front surface print area and the back surface printable area are different.

In this embodiment, a margin is added to the rear end of the print medium on the right side of FIG. 4B, that is, the rear end of the image. The length of the unprintable area 406 in the conveyance direction is the same as the distance from the conveyance rollers 206 to the most upstream nozzle 404. Hence, a margin equal to or more than the distance (length) from the conveyance rollers 206 to the most upstream nozzle 404 is added.

Figure 4C:
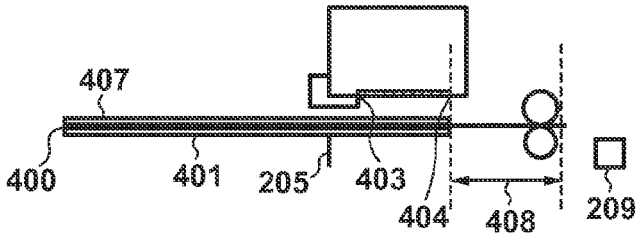

FIG. 4C is a view showing a state when a margin corresponding to the back surface unprintable area 406 is provided at the time of front surface printing, and back surface printing is completed.

As shown in FIG. 4C, a rear end margin 408 in an amount equal to the back surface unprintable area 406 is provided at the time of front surface printing. That is, the print medium is further conveyed from the position shown in FIG. 4A to the downstream side by an amount equal to the rear end margin 408, and the roll paper is cut in this state. This aligns a back surface printable area 407 with the front surface print area 401, as shown in FIG. 4C. The front surface print area 401 is not cut with reducing the surface image. That is, both the front surface and the back surface can be printed likewise without causing size change such as reduction or interruption of the output as in the conventional method.

In this state, however, a margin corresponding to the rear end margin 408 remains. The print medium cutting position is the position indicated by the flat blade 205. Since the print medium cannot be conveyed by the conveyance rollers 206 to the position of the flat blade 205, which is the cutting position corresponding to the rear end position of the back surface printable area 407, there is no choice but to cut the portion of the rear end margin 408 added by the user later. Hence, in this embodiment, the front surface is printed in consideration of not only the margin of the unprintable area but also the length necessary for cutting at the time of front surface printing. That is, a margin equal to or more than the distance (length) from the conveyance rollers 206 to the flat blade 205 is added.

Figure 4D:
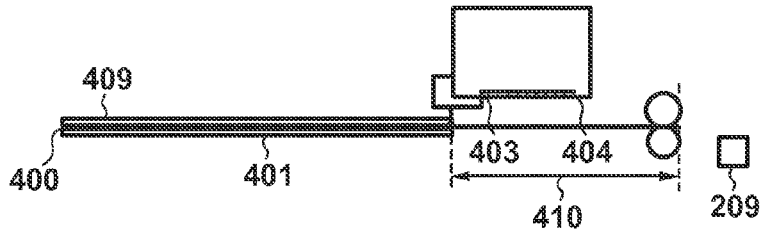

FIG. 4D is a view showing a state in which the roll paper is cut after a margin having a length necessary for cutting is added in front surface printing of the roll paper, back surface printing on the cut printed roll paper is completed, and the cutting operation is ended.

As shown in FIG. 4D, since a margin having a length 410 necessary for cutting is added, the print medium can be cut at the rear end of the printed image shown in FIG. 4D after back surface printing, and the front surface and the back surface of the print medium can wholly be printed. Note that a numeral 409 indicates a back surface printable area in a case where the margin having the length necessary for cutting is added.

As described above, in back surface printing of cut printed roll paper, rear end processing that is performed for cut paper is performed. More specifically, a parameter used to perform rear end processing of cut paper is set in back surface printing using cut printed roll paper.

As shown in FIG. 4B, when the print medium is cut later by the user or in post-processing, a rear end margin considering the unprintable area 406 is added at the time of front surface printing. In other words, after printing the front surface of roll paper, cutting control is done so as to cut the roll paper while leaving a set margin. It is therefore possible to perform processing in the same print area on the front and back surfaces. Additionally, as shown in FIG. 4C, a rear end margin is added in consideration of the length necessary for cutting at the time of front surface printing, and the marginal portion is cut at last. This makes it possible to print images of the same size on the front and back surfaces.

Figure 5:
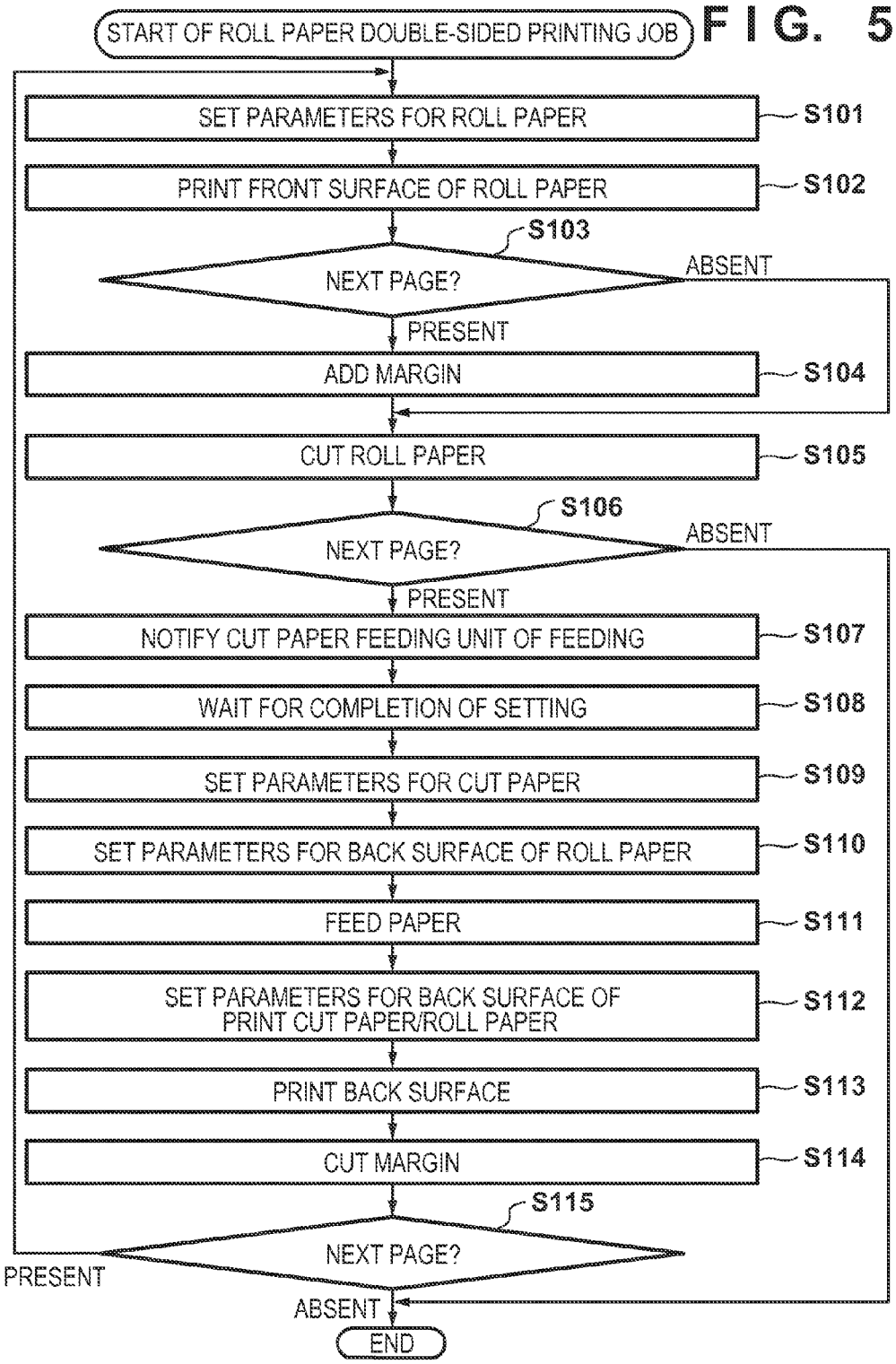
FIG. 5 is a flowchart showing conveyance control of double-sided printing using roll paper according to the first embodiment.

FIG. 5 is a flowchart showing conveyance control (drive control) of double-sided printing using roll paper according to the first embodiment.

The user transmits a job of roll paper double-sided printing to a printing apparatus 100 by a driver or the like installed in the host. Upon receiving the job of roll paper double-sided printing (double-sided printing on a roll-shaped print medium), the printing apparatus 100 starts double-sided printing of roll paper. The printing apparatus according to this embodiment copes with both a method of sequentially printing images on the front surface and the back surface in each printing corresponding to one cut paper sheet and a method of printing images on the front surface of one rolled sheet and then printing images on the back surface. Hence, since the printing apparatus copes with the two methods, the job may be transmitted with a designation of the printing method.

Note that in this embodiment, roll paper double-sided printing is assumed to indicate printing the front surface and the back surface in each printing corresponding to one cut paper sheet to simplify the explanation.

In this embodiment, the unit of printing is assumed to be printing corresponding to one cut paper sheet to simplify the explanation. The unit may be designated to, for example, each printing corresponding to one cut paper sheet or each printing corresponding to two cut paper sheets. For example, when the unit is set to each printing corresponding to two cut paper sheets, printing corresponding to two cut paper sheets may be performed first on the front surface of roll paper, and after that, printing corresponding to two cut paper sheets may be performed on the back surface at once. That is, since this embodiment is applicable to an arrangement that refeeds cut printed roll paper as cut paper and prints the back surface, printing corresponding to a plurality of cut paper sheets may continuously be performed. At this time, to associate the print order on the back surface with the print order on the front surface, the user may be able to designate which one of the first and second sheets should be printed first.

When printing of one job starts, interruption of another job never occurs until printing of all pages ends. In a printing apparatus capable of printing an image on both cut paper and roll paper, as in this embodiment, double-sided printing can be performed by printing an image on the front surface of roll paper, cutting the roll paper, overturning the paper, and refeeding it as cut paper. In this case, however, it is necessary to alternately generate image data for roll paper and cut paper in every copy of printing and transmit print jobs separately for the front surface and the back surface. A network printer or the like is shared by a plurality of users. Hence, while printed roll paper is being fed as cut paper, another printing may be started by a print job from another user. That is, if the print job to roll paper and that to cut paper are separated, another print job may interrupt during double-sided printing, and an image that should not be printed on the back surface may be printed, resulting in an error in association between the front surface and the back surface. To prevent this, in this embodiment, when a job for roll paper is received, it is handled as one job, and parameters for roll paper are used in front surface printing, whereas parameters for cut paper are used in back surface printing. That is, parameters for roll paper and parameters for cut paper are associated with the job for roll paper, and processing of the front surface and that of the back surface are performed. This allows the job of roll paper double-sided printing to be handled as one job until its end and prevents another print job from interrupting to lead to an error in association between the front surface and the back surface of the print medium.

In roll paper double-sided printing according to this embodiment, an image is printed on the front surface of roll paper, the roll paper is cut, the printed roll paper is refed as cut paper, and an image is finally printed on the back surface of the printed roll paper refed as cut paper.

In this embodiment, not parameters designated for roll paper but parameters for cut paper are set in some of parameters used in printing, thereby handling the roll paper as cut paper and performing double-sided printing on the roll paper without making the user be conscious of the difference between cut paper and roll paper. This reduces the labor of the user on double-sided printing using roll paper or cumbersomeness caused by the difference between the front surface and the back surface of the print medium.

When the printing apparatus 100 starts the roll paper double-sided printing job, the front surface of the roll paper can directly be printed. In step S101, parameters for roll paper printing are set. In step S102, the print unit is controlled so as to print the front surface of the roll paper.

At this time, when printed density information is to be used to calculate the parameters for printed roll paper in back surface, as described above, the print area and density information are calculated and stored in the memory 306. If the front end of the roll paper is located at the retracted position, as shown in FIG. 2A, the load operation in printing is performed to feed the front end of the roll paper to the platen 204 in step S102.

When performing double-sided printing corresponding to odd-numbered pages of cut paper, the back surface of the last page need not be printed. For this reason, in step S103, it is confirmed whether the next page exists. It may be confirmed whether the page is the last. Upon determining that the next page does not exist (or the page is the last), the process advances to step S105. Upon determining that the next page exists (or the page is not the last), the process advances to step S104. Note that when performing first printing of double-sided printing, the page of the back surface exists, and it is determined that the next page exists.

In step S104, the margin described with reference to FIGS. 4A to 4D is added, that is, the margin is added to the rear end of the front surface print area. More specifically, the margin is added to the rear end of the print area of back surface printing, that is, to the right side in FIGS. 2A and 2B and FIGS. 4A to 4D. Note that in a case where the front and rear ends in the feeding direction (front and rear ends in the printing direction) can freely be designated for the back surface, that is, in a case where the direction of the image in front surface printing and the direction of the image in back surface printing can be set to the 180-degree opposite directions, the margin is added before the print area, that is, to the front end side of the print area. In this case, the processes of steps S103 and S104 are performed for the front surface of roll paper before printing.

After the front surface printing, the roll paper is cut in step S105. In step S106, it is checked whether printing of the next page exists. Upon determining that printing of the next page does not exist, printing of a series of jobs has ended, and the processing ends. Upon determining that printing of the next page exists, process advances to step S107.

Processing of back surface printing is performed from then on.

In this embodiment, the user needs to overturn the cut printed roll paper and feed it to the feeding unit 107. Hence, in step S107, an instruction is displayed on an operation panel 104 to feed the paper to the feeding unit 107. During this display, the printing apparatus 100 retracts the roll paper that currently exists in the platen 204 and impedes the print operation from the state shown in FIG. 2A to the state shown in FIG. 2B. In this embodiment, the roll paper retracting operation is performed when the cut paper feeding instruction is displayed in step S107. However, this operation can be performed anytime until the cut paper feeding operation of step S111 (to be described later) starts. It is therefore possible to print the back surface of printed roll paper without continuously printing the page on the front surface of the roll paper.

In step S108, the processing waits for completion of printed roll paper setting in the feeding unit 107 by the user. When the sensor 213 discriminates the presence of the print medium, the operation panel 104 displays whether printed roll paper has been correctly set. When the user presses the OK key of the operation panel 104, the printing apparatus 100 determines that the setting is completed, and the process advances to step S109. Note that the feeding operation in steps S107 and S108 may be performed in the same way as in normal cut paper feeding, or feeding of cut printed roll paper may be designated. For example, display in step S107 may be done in the same way as in normal cut paper feeding or may be special display to display the set direction of printed roll paper.

In step S109, parameters in feeding are set. In this embodiment, roll paper is printed. In fact, the roll paper is cut and has the same shape as cut paper set in the feeding unit 107. Hence, in step S109, roll paper as shown in FIGS. 2A and 2B is not designated after refeed, and instead, parameters for cut paper are set to handle the processing as cut paper printing. As described above, the parameters change depending on the paper type and conditions. Hence, all parameters are not always set to parameters for cut paper, and part of parameters for roll paper may be used. In step S110, if a parameter for cut paper is not appropriate, another parameter is set as a parameter for the back surface of roll paper.

In step S109, for example, a large difference in the conveyance correction value no longer exists between roll paper and cut paper. Hence, conveyance errors decrease. In addition, values for printed roll paper having the third shape are set to convey the printed roll paper. For example, if the slip amount of the front surface changes due to inks printed on the front surface, conveyance errors are further reduced by, for example, further performing correction in addition to the parameters for cut paper depending on the printed density of the printed front surface. Similarly, since the platen suction amount and the head height can also take appropriate values by using values for printed roll paper, the above-described problems can be reduced. Note that if parameters for the back surface of roll paper are held in a table or the like, the cut paper parameter setting in step S109 may be omitted. If only cut paper parameter setting in step S109 suffices without any problem, step S110 may be omitted or executed for only a specific paper type.

In step S111, the printed roll paper set in the feeding unit 107 is pulled in to the position shown in FIG. 2B. After that, the printed roll paper is conveyed further downstream, and the sensor unit 202 detects the end information of the print medium. The front end position or left/right end positions of the print medium can thus be detected, and the paper width, skew amount, and the like can also be calculated. After the detection, the detected front end of the print medium is moved to the position conveyed by 5 mm from the conveyance rollers 206, as shown in FIG. 2B, and the feeding operation ends.

In the feeding operation, it has already been confirmed in step S108 that the paper is printed roll paper. Hence, for example, detection of known information such as the paper width may be omitted here if information held in the memory 306 is used. However, information that affects the values of parameters set in step S109, for example, width information may be set again after the detection. When the feeding operation ends, the process advances to back surface printing.

In step S112, parameters in printing, which are different from those in feeding, are set as needed, as in steps S109 and S110. If the parameters in feeding are the same as those in printing, the parameters need not be set here. For example, the suction amount of the platen changes between feeding and printing and is therefore set here. Similarly, the head height is also different from the parameter in printing and is therefore set again here.

Note that in this embodiment, the parameters are set before processing. However, the parameters may be obtained and used as needed. In this case, in steps S109, S110 and S112, processing of the series of parameters is unnecessary, and the parameters are obtained as needed in feeding or printing. After that, in step S113, the print unit is controlled so as to print the back surface of the cut printed roll paper in accordance with the parameters set in step S112. After the end of the printing, in step S114, the margin (the state as shown in FIG. 4D) unnecessary for the printing result to which the margin is added in step S104 is cut, the paper is discharged, and the back surface printing ends.

In step S115, it is checked whether the next page to print exists. Upon determining that the next page to print exists, the process returns to step S101 to print the next page on the front surface of the roll paper. Upon determining that the next page to print does not exist, the job of roll paper double-sided printing ends.

Hence, according to the above-described embodiment, in roll paper double-sided printing, it is possible to reduce the problems in back surface printing caused by the difference in the print medium shape between the front surface and the back surface. That is, it is possible to suppress unevenness or a problem in printing. After printing the front surface of roll paper, an appropriate margin is added to the rear end side of the front surface print area. After that, the roll paper is cut, and the cut printed roll paper is inverted, fed, and used for back surface printing. It is therefore possible to balance the margin on the front surface and that on the back surface and perform printing in the same size on the front surface and the back surface.

Note that as for the margin addition after front surface printing, the above-described margin addition may be done by shifting the cutting position in the roll paper cutting operation or by adding margin data to the rear end of image data. If the margin is added before printing, the write position may simply be shifted to the rear side, or the margin may be added by adding margin data to the front end of image data.

Second Embodiment

In double-sided printing according to the first embodiment, after printing the front surface of roll paper, the roll paper is cut, and the user manually inverts the cut printed roll paper and places it in the feeding unit 107 to perform back surface printing. In the second embodiment, however, an example will be described in which an automatic inversion mechanism for cut printed roll paper is provided in the printing apparatus, and double-sided printing is performed by causing the mechanism to invert cut printed roll paper.

Figure 6A:
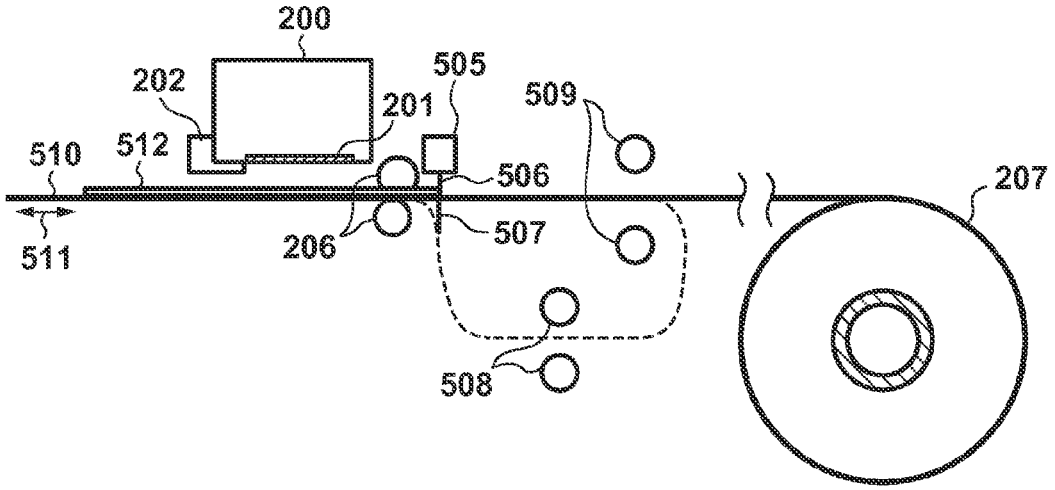
FIGS. 6A, 6B, and 6C are side sectional views showing part of a printing apparatus so as to illustrate an example of states at the time of printing according to the second embodiment.
Figure 6B:
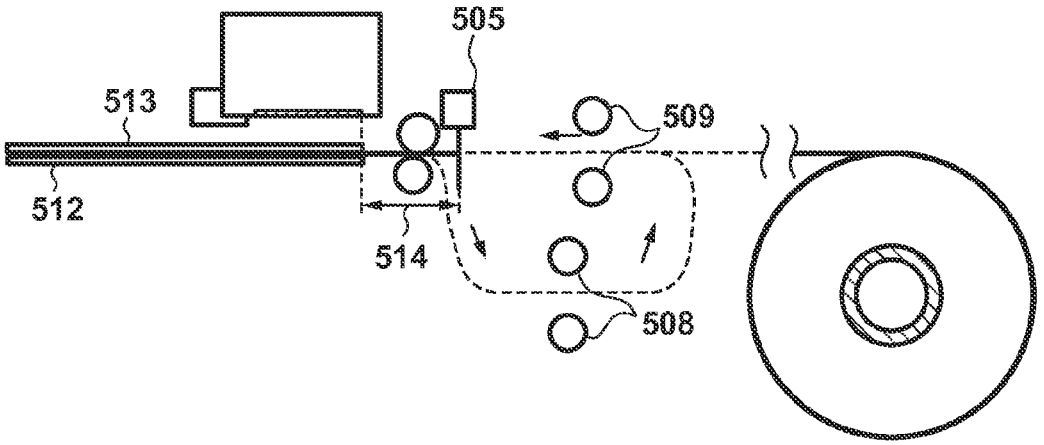
Figure 6C:
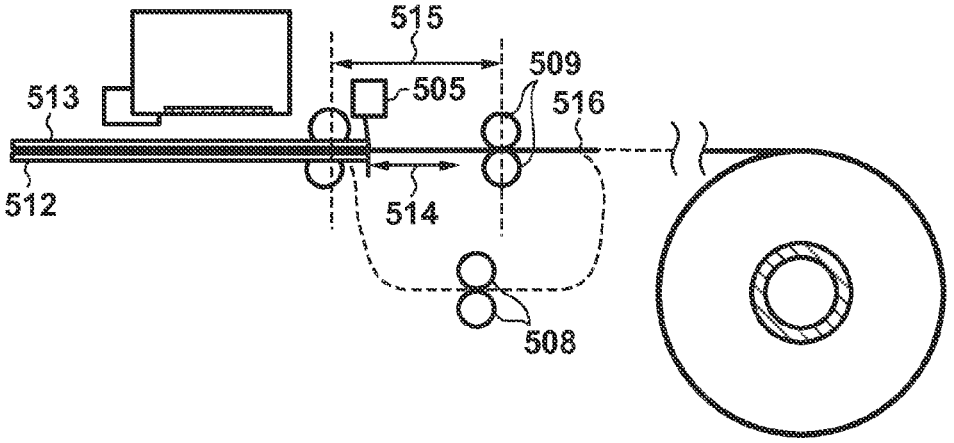

FIGS. 6A to 6C are side sectional views showing states of a printing apparatus according to the second embodiment at the time of printing. FIGS. 6A to 6C are the same as FIGS. 4A to 4D according to the first embodiment. Hence, the same reference numerals as in FIGS. 4A to 4D denote the same constituent elements as those mentioned in FIGS. 6A to 6C, and a description thereof will be omitted.

In this embodiment, an inversion mechanism that automatically inverts printed roll paper and a conveyance path are provided on the upstream side of conveyance rollers 206 with respect to the conveyance direction. According to this arrangement, a cutter is also moved to the upstream side of the conveyance rollers 206. As shown in FIGS. 6A to 6C, a cutter unit 505 can operate independently of a carriage 200, unlike the arrangement shown in FIGS. 4A to 4D. In this embodiment, a flat blade 507 and a round blade 506 of the cutter unit 505 sandwich a print medium, thereby cutting the print medium. The rest of the arrangement is the same as in the first embodiment.

The cutter unit 505 is located at a position on the near side in the drawings, that is, outside the print medium. To cut the print medium, the cutter unit 505 moves from the near side to the far side in the drawings and cuts the print medium. After the print medium is cut, the print medium is slightly moved away to avoid contact with the cut print medium, and the cutter unit 505 is returned to the position on the near side in the drawings.

The printed roll paper inversion mechanism according to this embodiment provides first additional conveyance rollers 508 and second additional conveyance rollers 509 in the conveyance path indicated by the broken line. The cut printed roll paper is conveyed to the conveyance path so as to be inverted. Note that the first additional conveyance rollers 508 and the second additional conveyance rollers 509 are configured to open/close, like feed rollers 208 and 212.

FIG. 6A shows a state in which front surface printing of roll paper is completed, and printed roll paper 510 is cut. In particular, FIG. 6A shows a state in which a margin equal to a rear end margin 408 is provided, as shown in FIG. 4C. In this embodiment, however, since the print medium is automatically inverted after front surface printing, a margin 511 in back surface printing is provided at the front end of the print medium in front surface printing. After that, printing is performed in a front surface print area 512, and then the roll paper with its front surface printed is rewound again and cut. FIG. 6A shows this state.

The margin in front surface printing shown in FIGS. 4A to 4D according to the first embodiment is added to the rear end side of the image. In this embodiment, however, the margin 511 is added to the front end side of the image, as shown in FIGS. 6A to 6C.

Next, roll paper 207 is retracted from the state shown in FIG. 6A, and the printed roll paper 510 is refed. At the time of refeeding, parameters for roll paper are not designated, and more appropriate parameters for cut paper are set so as to handle the printed roll paper as cut paper. Note that the values of parameters (conveyance errors) partially change in refeeding because the first additional conveyance rollers 508 and the second additional conveyance rollers 509 are used. However, the correction values for cut paper may directly be used because conveyance errors can be decreased by using not correction values for roll paper but correction values for cut paper, as described in the first embodiment. Similarly, the suction fan of the platen, the head height, and the like do not change in the configuration, and the parameters are directly used.

In refeeding, the printed roll paper is conveyed in the direction of the arrow in FIG. 6B using the conveyance rollers 206, the first additional conveyance rollers 508, and the second additional conveyance rollers 509 and inverted. After inversion, when the print medium has become conveyable by the conveyance rollers 206, the first additional conveyance rollers 508 and the second additional conveyance rollers 509 are opened, like the feed rollers 208 and 212, to set a print standby state.

FIG. 6B shows a state in which back surface printing is performed from the print standby state, and the processing ends. FIG. 6B shows a state in which the print medium is conveyed to the most downstream side.

As is apparent from FIG. 6B, since no inks can be discharged from the nozzles to the sheet surface on the upstream side of the most upstream nozzle, a printable area 513 and an unprintable area 514 are formed on the back surface. In this embodiment as well, since the margin 511 having the same length as the unprintable area 514 is added in advance, as shown in FIG. 6A, the front surface print area 512 and the printable area 513 of the back surface have almost the same length, as shown in FIG. 6B, as in the first embodiment.

In FIG. 6B, the arrangement on the downstream side of the conveyance rollers 206 is the same as that shown in FIGS. 4A to 4D except the position of the cutter. Hence, it is possible to return the print medium to the cutting position in this state and cut the marginal portion. However, if the print medium is directly returned and cut, as shown in FIG. 6A, neither the conveyance rollers 206 nor the second additional conveyance rollers 509 can hold the cut shred like the unprintable area 514 shown in FIG. 6C. Hence, the shred remains in the printing apparatus and causes jam or the like.

Hence, front surface printing may be executed in consideration of not only the margin corresponding to the unprintable area but also a length necessary for discharge without leaving any shred after cutting. That is, a margin having a length necessary for subsequent discharge, that is, a length equal to or more than a length 515 from the conveyance rollers 206 to the second additional conveyance rollers 509 is added as the margin necessary in discharge. If the length of the margin in the conveyance direction equals the distance 515 from the conveyance rollers 206 to the second additional conveyance rollers 509, the length of the margin may not reach the distance between the rollers depending on a condition of the print medium such as expansion/contraction or curl. Hence, a value obtained by adding 10 mm to the length 515 is used as a margin 516.

FIG. 6C is a view showing a state in which front surface printing is performed after the margin 516 is provided, the print medium is automatically inverted and refed, back surface printing is completed, and the margin 516 is cut.

Hence, according to the above-described embodiment, the print medium can be cut at its rear end, as shown in FIG. 6C, and the entire back surface can be printed. In addition, since the cut marginal portion can also be nipped by the rollers, the marginal portion can also be discharged. As described above, even when the print medium that has undergone front surface printing is automatically inverted, the front surface and the back surface can wholly be printed by providing the margin.

The conveyance control sequence of double-sided printing using roll paper can be executed in accordance with almost the same procedure as the flowchart shown in FIG. 5. However, steps S107 and S108 of FIG. 5 can be omitted because of the automatic inversion mechanism of the print medium.

According to the above-described two embodiments, as parameters necessary in back surface printing of roll paper double-sided printing, more appropriate parameters for cut paper are set, and roll paper is handled as cut paper. This makes it possible to print the back surface while reducing the problems in back surface printing caused by the difference in the print medium shape. In addition, in a case where the printed density and the like are used as parameters in use of printed roll paper, the problems in back surface printing caused by the difference in the shape can further be reduced. After a margin is added in front surface printing, the roll paper is cut, thus making it possible to print effectively using the entire front and back surfaces of the print medium. It is therefore possible to perform satisfactory printing by reducing the labor of the user or the problems caused by the shape difference between the front surface and the back surface.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-075719, filed Apr. 1, 2014, which is hereby incorporated by reference herein in its entirety.

What is claimed is:

1. A print control apparatus comprising:

a reception unit configured to receive a job of printing for a roll-shaped print medium or a job of printing for a cut print medium;

a first feeding unit configured to feed the roll-shaped print medium if a job of printing for a roll-shaped print medium is received by said reception unit;

a second feeding unit configured to feed the cut print medium if a job of printing for a cut print medium is received by said reception unit;

a print control unit configured to cause a print unit to print an image on the roll-shaped print medium, a cut roll-shaped print medium or the cut print medium based on the job received by said reception unit; and a drive control unit configured to control a predetermined drive, based on a drive parameter, wherein after said print control unit causes the print unit to print an image on a first surface of the roll-shaped print medium, said print control unit causes the print unit to print an image on a second surface of the cut roll-shaped print medium, the cut roll-shaped print medium being obtained by cutting the roll-shaped print medium, and the second surface of the cut roll-shaped print medium being opposite to the first surface of the cut roll-shaped print medium on which the image has been printed, and said drive control unit controls the predetermined drive based on a first drive parameter upon printing on the first surface of the roll-shaped print medium fed from said first feeding unit, controls the predetermined drive based on a second drive parameter different from the first drive parameter upon printing on the second surface of the cut roll-shaped print medium, and controls the predetermined drive, based on a third drive parameter different from the first drive parameter and the second drive parameter upon printing on the cut print medium fed from said second feeding unit.

2. The apparatus according to claim 1, further comprising the print unit.

3. The apparatus according to claim 1, further comprising a display unit configured to display an instruction for a user to place the cut roll-shaped print medium in the second feeding unit.

4. The apparatus according to claim 1, wherein the drive control unit controls a suction of the print medium based on a first suction amount upon printing on the first surface of the roll-shaped print medium, controls the suction of the print medium based on a second suction amount larger than the first suction amount upon printing on the second surface of the cut roll-shaped print medium, and controls the suction of the print medium based on a third suction amount smaller than the second suction amount upon printing on the cut print medium.

5. The apparatus according to claim 1, wherein the drive control unit controls a conveyance of the print medium pulse upon printing on the first surface of the roll-shaped print medium, controls the conveyance of the print medium based on a second conveyance pulse smaller than the first conveyance pulse upon printing on the second surface of the cut roll-shaped medium, and controls the conveyance of the print medium based on a third conveyance pulse smaller than the first conveyance pulse upon printing on the cut print medium.

6. The apparatus according to claim 1, wherein the drive control unit controls at least one of a suction of the print medium, a conveyance of the print medium and a height of a printhead, based on the drive parameter.

7. The apparatus according to claim 1, wherein the drive control unit controls the predetermined drive based on the first drive parameter that is changed in accordance with a type of the roll-shaped print medium upon printing on the first surface of the roll-shaped print medium, controls the predetermined drive based on the second drive parameter that is changed in accordance with a type of the cut roll-shaped print medium upon printing on the second surface of the cut roll-shaped print medium, and controls the predetermined drive based on the third drive parameter that is changed in accordance with a type of the cut print medium upon printing on the cut print medium.

8. A control method executed in a print control apparatus having a first feeding unit configured to feed a roll-shaped medium if a job of printing for the roll-shaped print medium is received by the print control apparatus and a second feeding unit configured to feed a cut print medium if a job of printing for the cut print medium is received by the print control apparatus, the method comprising:

receiving the job of printing for the roll-shaped print medium or the job of printing for the cut print medium;

causing a print unit to print an image on the roll-shaped print medium, a cut roll-shaped print medium, or the cut print medium based on the received job; and controlling a predetermined drive, based on a drive parameter, wherein in the printing by the print unit, after the print unit is caused to print an image on a first surface of the roll-shaped print medium, the print unit is caused to print an image on a second surface of the cut roll-shaped print medium, the cut roll-shaped print medium being obtained by cutting the roll-shaped print medium, and the second surface of the cut roll-shaped print medium being opposite to the first surface of the cut roll-shaped print medium on which the image has been printed, and the predetermined drive is controlled based on a first drive parameter upon printing on the first surface of the roll-shaped print medium fed from the first feeding unit, the predetermined drive is controlled based on a second drive parameter different from the first drive parameter upon printing on the second surface of the cut roll-shaped print medium, and the predetermined drive is controlled based on a third parameter different from the first drive parameter and the second drive parameter upon printing on the cut print medium fed from the second feeding unit.

9. The method according to claim 8, further comprising displaying an instruction for a user to place the cut roll-shaped print medium in the second feeding unit.

10. The method according to claim 8, wherein a suction of the print medium is controlled based on a first suction amount upon printing on the first surface of the roll-shaped print medium, the suction of the print medium is controlled based on a second suction amount larger than the first suction amount upon printing on the second surface of the cut roll-shaped print medium, and the suction of the print medium is controlled based on a third suction amount smaller than the second suction amount upon printing on the cut print medium.

11. The method according to claim 8, wherein a conveyance of the print medium is controlled based on a first conveyance pulse upon printing on the first surface of the roll-shaped print medium, the conveyance of the print medium is controlled based on a second conveyance pulse smaller than the first conveyance pulse upon printing on the second surface of the cut roll-shaped medium, and the conveyance of the print medium is controlled based on a third conveyance pulse smaller than the first conveyance pulse upon printing on the cut medium.

12. The method according to claim 8, wherein at least one of a suction of the print medium, a conveyance of the print medium and a height of a printhead is controlled based on the drive parameter.

13. The method according to claim 8, wherein the predetermined drive is controlled based on the first drive parameter that is changed in accordance with a type of the roll-shaped print medium upon printing on the first surface of the roll-shaped print medium, the predetermined drive is controlled based on the second drive parameter that is changed in accordance with a type of the cut roll-shaped print medium upon printing on the second surface of the cut roll-shaped print medium, and the predetermined drive is controlled based on the third drive parameter that is changed in accordance with a type of the cut print medium upon printing on the cut print medium.

14. A print control apparatus comprises:

a reception unit configured to receive a job of printing for a roll-shaped print medium or a job of printing for a cut print medium;

a first feeding unit configured to feed the roll-shaped print medium if a job of printing for a roll-shaped print medium is received by said reception unit;

a second feeding unit configured to feed the cut print medium if a job of printing for a roll-shaped print medium is received by said reception unit;

a print control unit configured to cause a print unit to print an image on the roll-shaped print medium, a cut roll-shaped print medium that is obtained by cutting the roll-shaped print medium, or the cut print medium based on the job received by said reception unit; and a drive control unit configured to control a predetermined drive based on a drive parameter, wherein after said print control unit causes the print unit to print an image on a first surface of the roll-shaped print medium, said print control unit causes the print unit to print an image on a second surface of the cut roll-shaped print medium, the cut roll-shaped print medium being obtained by cutting the roll-shaped print medium, and the second surface of the cut roll-shaped print medium being opposite to the first surface of the cut roll-shaped print medium on which the image has been printed, and said drive control unit controls the predetermined drive based on a first drive parameter upon printing on the first surface of the roll-shaped print medium fed from said first feeding unit, and controls the predetermined drive based on a second drive parameter different from the first drive parameter upon printing on the second surface of the cut roll-shaped print medium and the cut print medium fed from said second feeding unit.

* * * * *